US005564638A

United States Patent [19]

Schmitz

[11] Patent Number: 5,564,638

[45] Date of Patent: Oct. 15, 1996

[54] MULTI-STATION TEXTILE WINDING MACHINE FOR PRODUCING CHEESES

[75] Inventor: Wilhelm Schmitz, Mönchengladbach, Germany

[73] Assignee: W. Schlafhorst AG & Co., Moenchengladbach, Germany

[21] Appl. No.: 372,949

[22] Filed: Jan. 17, 1995

[30] Foreign Application Priority Data

Jan. 26, 1994 [DE] Germany ..... 44 02 175.5

[51] Int. Cl.[6] ..... B65H 54/02; B65H 69/04; D01H 11/00

[52] U.S. Cl. ..... 242/35.5 R; 57/304; 137/861; 242/35.6 R

[58] Field of Search ..... 242/355 R, 35.6 R; 57/304, 22, 264, 333, 350; 137/861

[56] References Cited

U.S. PATENT DOCUMENTS

| | | | |
|---|---|---|---|
| 2,783,950 | 3/1957 | Furst | 242/35.5 R |
| 3,986,328 | 10/1976 | Harrap | 57/304 X |
| 4,232,509 | 11/1980 | Rohner et al. | 242/35.6 R X |
| 4,319,720 | 3/1982 | Ueda | 242/35.5 R |
| 4,673,138 | 6/1987 | Ichiba | 242/35.6 R X |
| 4,947,509 | 8/1990 | Dinkelmann | 57/304 X |
| 4,988,049 | 1/1991 | Konishi | 242/35.5 R |

FOREIGN PATENT DOCUMENTS

| | | |
|---|---|---|
| 77038 | 11/1970 | Germany . |
| 2153337 | 5/1972 | Germany . |
| 3823289A1 | 1/1989 | Germany . |
| 58-74463 | 5/1983 | Japan . |

OTHER PUBLICATIONS

Operating Manual, W. Schlafhorst & Co., entitled "Autoconer 238", Sections 01.2.5 and 01.2.5(2) (German and English).

Kurt Steiner, Lösung von Sonderbedingungen in der Pneumatik. In: Europäische Techn. Inf. Fördertechnick und Transport, 1967, pp. 89–95.

*Primary Examiner*—Michael R. Mansen
*Attorney, Agent, or Firm*—Shefte, Pinckney & Sawyer

[57] ABSTRACT

A textile winding machine having a plurality of work stations each of which has a number of pneumatically actuable operating components. The operating components are connected to separate compressed air lines each having at least two compressed air supply locations each associated with a respective pressure controller. The compressed air lines are dividable in turn into machine segments operating at different pressure levels by means of selectively actuable valve elements disposed in the compressed air line between the pressure controllers.

9 Claims, 6 Drawing Sheets

MULTI-STATION TEXTILE WINDING MACHINE FOR PRODUCING CHEESES

FIELD OF THE INVENTION

The present invention relates to a textile winding machine for producing cross-wound bobbins, sometimes referred to as cheeses, having a number of winding stations, each with a number of pneumatically actuable components operating at different pneumatic working pressures, and a compressed air distribution network for the overall machine having compressed air lines extending along the machine, each carrying compressed air at a defined working pressure, from which branch lines extend to deliver the compressed air to the various operating components at the winding stations.

BACKGROUND OF THE INVENTION

Textile winding machines representative of the above-described type are manufactured by W. Schlafhorst & Co., of Mönchengladbach, Germany, under the designation AUTOCONER 238, as described, for instance, in an operating manual published by W. Schlafhorst, entitled AUTOCONER 238.

Automatic cheese-producing textile machines of this kind typically have compressed air distribution systems, which are connected via energy units of the machine itself to a compressed air network supplying the entire spinning factory. As a rule, these energy units have a filter/water separator, a pressure monitor that monitors the input pressure and triggers an electromagnetic multi-position valve disposed at the compressed air input, and a number of pressure controllers.

By means of these pressure controllers, the pressure available at the compressed air input to the machine, typically at a level of 7 to 8 bar in the compressed air network of the spinning factory, is reduced to the different working pressures required of the pneumatic operating components of the textile machine, typically at the level of from 3 to 6 bar, and distributed via compressed air lines to the work stations of the textile machine. These compressed air lines typically comprise a number of plastic tubes that are joined into individual line segments and are each connected to one pressure controller via a connecting hose. At the work stations, connecting unions or like devices are disposed on the compressed air lines, so that branching compressed air lines can be attached.

The various compressed air lines, which each carry compressed air at a certain pressure level, are tapped via the branch lines, so that at each work station of the textile machine compressed air is available at the required pressure level, such as 3 bar, 5 bar, 6 bar, etc. Electromagnetic valves are also disposed in the various branches and are triggerable in a defined fashion via a winding station control unit or device to assure a targeted supply of variously required levels of compressed air to the various operating components, such as a cleaning device, opener tubules, splicers, etc.

The compressed air supply devices described above have proven themselves in practice to function very reliably. When the bobbin winding machine is processing multiple batches, however, and especially if the differing yarns to be processed make differing demands of the pneumatic operating components, it can become relatively complicated to supply a proper level of compressed air to the various operating components at each winding station.

Heretofore, for instance, it has been common for identical operating components of differing operating stations that are required to work at different pressure levels, e.g., adjacent groups or sections of winding stations, each to be supplied via separate pressure lines carrying the respectively required pressure levels. Since the various operating components are physically connected to the applicable compressed air line, converting them to another working pressure can prove to be somewhat difficult. For this purpose, it has been necessary first to disconnect the operating components from one pressure line and then to reconnect them to another pressure line, which can be relatively complicated.

SUMMARY OF THE INVENTION

Based on the above prior art, it is an object of the invention to create an improved compressed air supply apparatus for a cheese-producing textile winding machine.

According to the invention, this object is attained in a textile winding machine for producing cross-wound bobbins which comprises a plurality of winding stations each having a plurality of pneumatically actuable operating components operable at different working pressures and a compressed air distribution network comprising compressed air lines extending along the textile machine each carrying pressurized air at a respective defined working pressure and branch lines associated with each winding station for connecting the operating components thereof to the network, by providing each compressed air line with at least two compressed air supply locations, a pressure controller associated with each supply location, and a plurality of valve elements at selected locations in the compressed air line between the supply locations for dividing the compressed air line into segments for operating at different pressure levels from one another according to the settings of the pressure controllers.

The compressed air distribution network of the present invention offers the particular advantage of great flexibility, since differing machine regions or sections in which certain differing working pressures are required of the operating components of the winding sections can be defined very easily and can optionally be adapted to changed conditions without major effort. The valve elements incorporated into the compressed air lines, which are preferably actuable via a control device, enable problem-free targeted selection of certain machine segments or sections that should be supplied with compressed air at a desired pressure level. Since each compressed air line has at least two compressed air supply locations, the possibility also exists that, by utilizing the valve elements for dividing the compressed air lines according to defined machine sections, identical pneumatically actuable operating components at the winding stations of differing machine sections can be operated at different working pressures from compressed air supplied simultaneously to each machine section through the same compressed air line.

In a preferred embodiment, the compressed air supply locations of each compressed air line and their associated pressure controllers are disposed at the ends of the respective compressed air line. Such an embodiment offers the particular advantage that the selectable machine segments to be supplied via the compressed air lines can assume a maximum length; i.e., the machine segments with the same pressure requirement can, if need be, extend even over the entire length of the textile machine. In this way, the textile machine can for instance be supplied selectively with one or the other pressure level. Thus, the adjustable length of the various machine segments is defined only by the position of the valve elements.

In a first embodiment, the valve elements are disposed at the boundaries between sections of the machine each having multiple winding stations, in which case a single machine section is the smallest unit which can be selected to be supplied with a given pressure level within any one compressed air line.

A further embodiment provides for separating any one or all of the compressed air lines by valve elements that are disposed between each successive winding station. In this manner, substantially greater flexibility is possible for selectively determining any desired number of winding stations in any compressed air line to be supplied with a differing operating pressure.

According to a further feature of the invention, any one or more of the compressed air lines may be equipped with a third pressure controller and a third compressed air supply location which makes it possible to supply each compressed air line at three differing pressure levels for processing simultaneously three types of yarn each of which requires a different manner of operation of the pneumatically actuable operating components.

DESCRIPTION OF THE PREFERRED EMBODIMENTS

Figure 1:
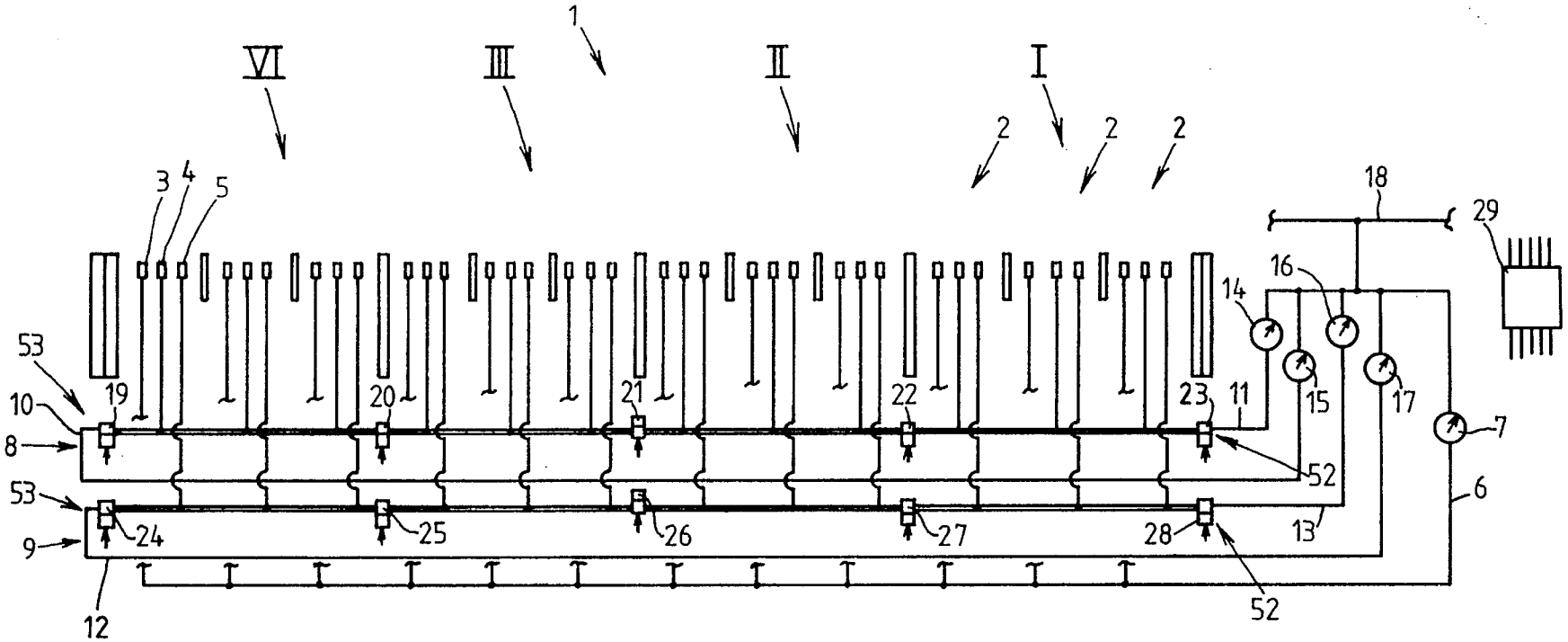
FIG. 1 a schematic diagram depicting a first exemplary embodiment of a compressed air supply arrangement for a textile bobbin winding machine according to a preferred embodiment of the present invention.

Referring now to the accompanying drawings and initially to FIG. 1, a compressed air distribution network of a bobbin winding machine identified overall by reference numeral 1 is schematically illustrated. The bobbin winding machine 1 is composed as is conventional of a number of machine sections I, II and III, which in turn each have a plurality of winding stations 2, typically ten stations per section. The structure and operation of such winding stations is well known and therefore need not be described in detail. Disposed in the region of the various winding stations 2 are various pneumatically actuable operating components, such as by way of example but not limitation a multi-jet device 3 (i.e. a blower device to clean zones of the winding station particularly subject to dust and lint accumulation), a yarn end opener 4 and a splicer 5. As indicated in the drawing, all the multi-jet devices 3 of the textile winding machine are supplied via a common compressed air line 6 having a pressure controller 7 incorporated into its input end. Typically, the operating pressure of these pneumatic operating components is approximately 3.5 bar, regardless of the material being processed at the winding stations.

The yarn end openers 4 and the splicers 5 are each connected via individual branch lines to separate compressed air lines 8 and 9, respectively, which communicate at one end with pressure controllers 14, 15 and 16, 17, respectively, via connecting lines 10, 11 and 12, 13, respectively. The pressure controllers 7, 14–17 are in turn connected at their respective input ends to the compressed air network 18 of the spinning factory. Incorporated into the compressed air lines 8 and 9 at the boundaries between the machine sections are respective valve elements 19–23 and 24–28, which are individually actuable, preferably via a control device 29.

As can be seen from FIG. 1, the compressed air line 8 can be supplied with compressed air via the connecting line 11 at one pressure level, e.g., a pressure of 5 bar, established at the pressure controller 14 and via the connecting line 10 at another pressure level, e.g., a pressure of 4.5 bar, adjusted at the pressure controller 15. By suitable actuation of the valves 19–23, it can be established which section or sections of winding stations of the machine are supplied with compressed air at a certain pressure level, or in other words to which machine section(s) compressed air at the pressure level set at the controller 14 is supplied and which machine section(s) will be supplied with the pressure established at the controller 15. In the exemplary embodiment shown, the valve element 21 is depicted as closed, as signified by the upward disposition of the valve 21, while the valve elements 19, 20, 22, 23 are opened, as signified by their illustrated downward disposition. As a result, a pressure of 5 bar is present in the compressed air line 8 in the region of machine sections I and II supplied by the line 11, and a pressure of 4.5 bar is present in the line 8 in the region of machine sections III and IV supplied by the line 10. The machine sections having the different pressure levels can easily be changed at any time by suitable actuation of the valves 19–23.

A similar arrangement of valve elements 24–28 is provided in the compressed air line 9 so that the splicers 5 can be acted upon, depending on the actuation of the valve elements 24–28, at one pressure level, e.g., a pressure of 4.2 bar, set at the pressure controller 16 or at another pressure level, e.g., the pressure of 3.8 bar, set at the pressure controller 17. As will thus be understood, the structural embodiment of the apparatus of FIG. 1 makes it suitable for multi-batch processing by the bobbin winding machine and particularly offers the opportunity of processing two different yarn types section by section where the yarn types require different working pressures for the yarn end openers 4 and/or splicers 5.

Figure 3:
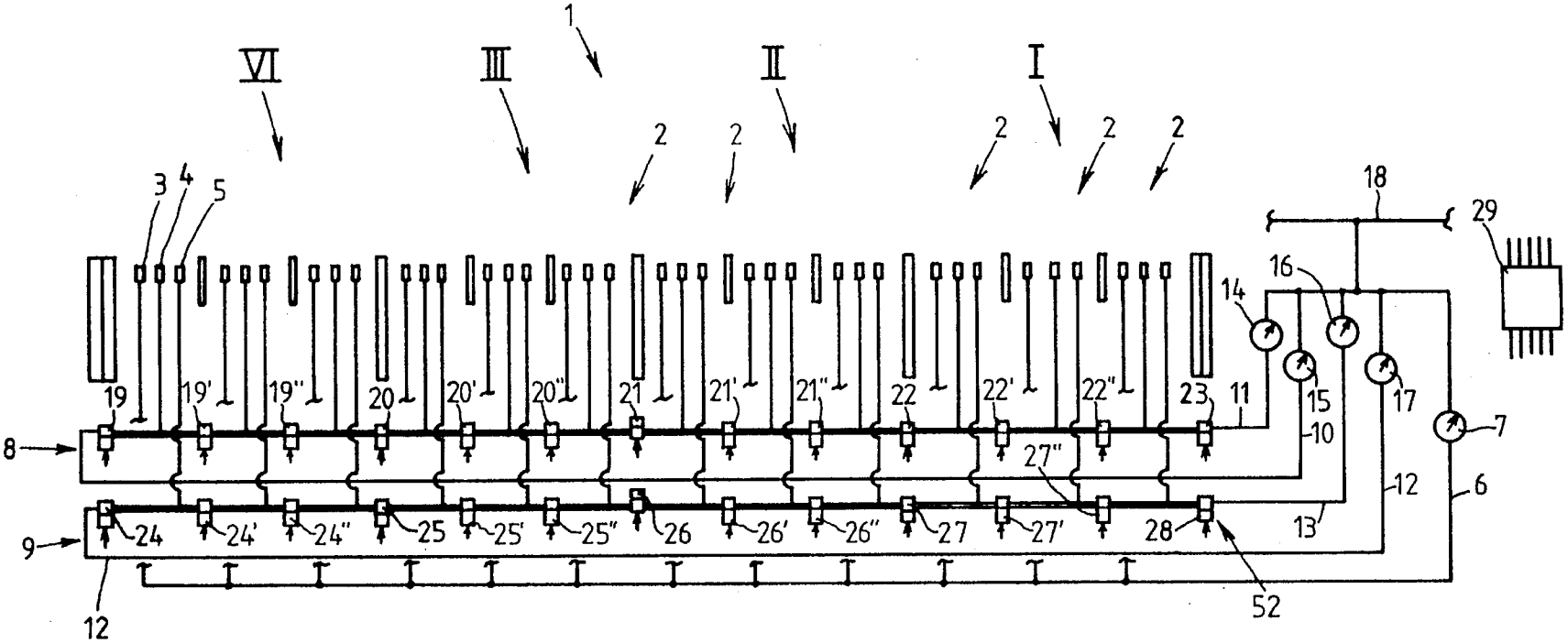
FIG. 3 is another schematic diagram similar to FIG. 1 showing a third embodiment of the present invention, but with valve elements disposed in the compressed air supply arrangement between each winding station.

The alternative embodiment shown in FIG. 3 differs from the apparatus of FIG. 1 described above in that the respective compressed air lines 8 and 9 are subdivided from one winding station to another by valve elements 19, 19', 19", 20, 20', 20", etc. In this manner, the adjustable pressure supply zones are no longer limited to entire machine sections I, II, etc. of multiple winding stations.. Instead, it is possible to locate the boundary of the pressure supply zones in the region of any individual selected winding station 2.

Figure 2:
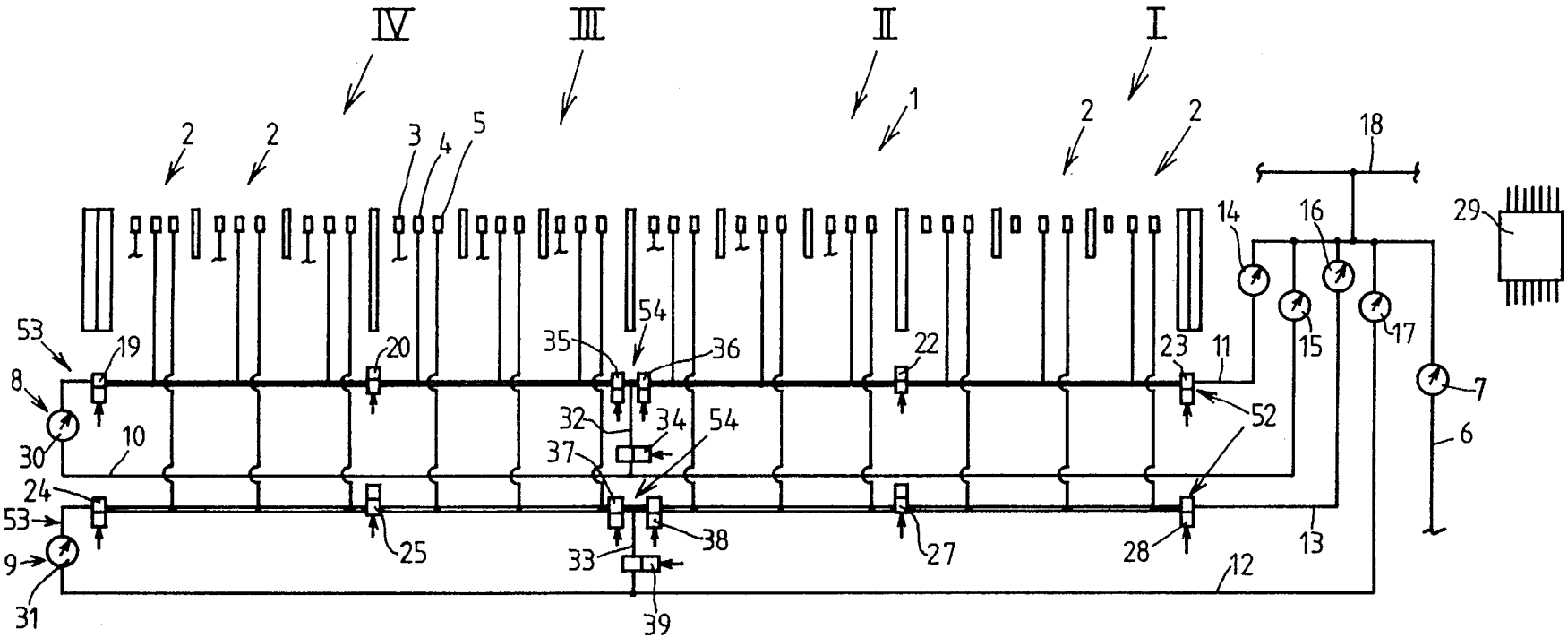
FIG. 2 is another schematic diagram similar to FIG. 1 showing a second embodiment of the present invention.
Figure 4:
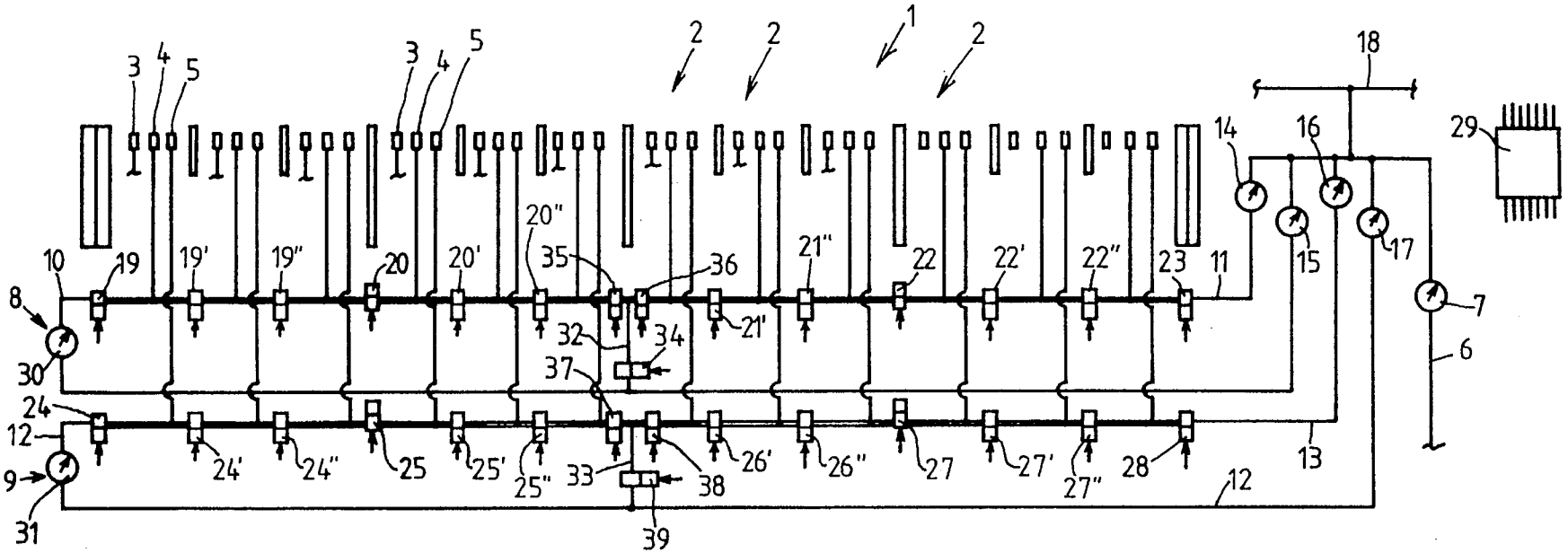
FIG. 4 is another schematic diagram similar to FIG. 1 showing a fourth embodiment of the present invention wherein the compressed air lines represent a combination of the arrangements of FIG. 2 and FIG. 3.

FIGS. 2 and 4 show further embodiments that are essentially comparable to the exemplary embodiments described above for FIG. 1 and FIG. 3, respectively, but with a modified structural arrangement which makes it possible to process three different types of yarn on the bobbin winding machine. As shown, additional pressure controllers 30 and 31 are incorporated into the respective connecting lines 10 and 12 to adjust the pressure levels (e.g., 4.5 bar and 3.8 bar) set at the pressure controllers 15 and 17, respectively, downwardly, e.g., to 4.1 bar and 3.3 bar. Each respective compressed air line 8 and 9 also communicates with its associated connecting line 10 and 12, respectively, via respective transverse lines 32 and 33, for example in the region of the boundary between the machine sections II,III. Valve elements 34 and 39, respectively, are incorporated into the transverse lines 32, 33 and are likewise actuable by the control device 29. The respective compressed air lines 8 and 9 preferably have further valve elements 35, 36 and 37, 38, respectively, to the right and left of the connection to the respective transverse lines 32 and 33.

As already indicated above, bobbin winding machines that have such an arrangement of compressed air lines are capable of processing simultaneously three batches of yarn which make different demands of the pneumatically actuable operating components. For example, if as noted the valve elements 20, 22 in the compressed air line 8 are closed and the other valve elements in this line are open, then the pressure level set at the pressure controller 14 is established in the region of machine section I, while the pressure set at the pressure controller 15 prevails in the region of the machine sections II and III, and the pressure level set at the pressure controller 30 prevails in the region of machine section IV. The pressure conditions in the compressed air line 9 are likewise adjustable accordingly.

Figure 5:
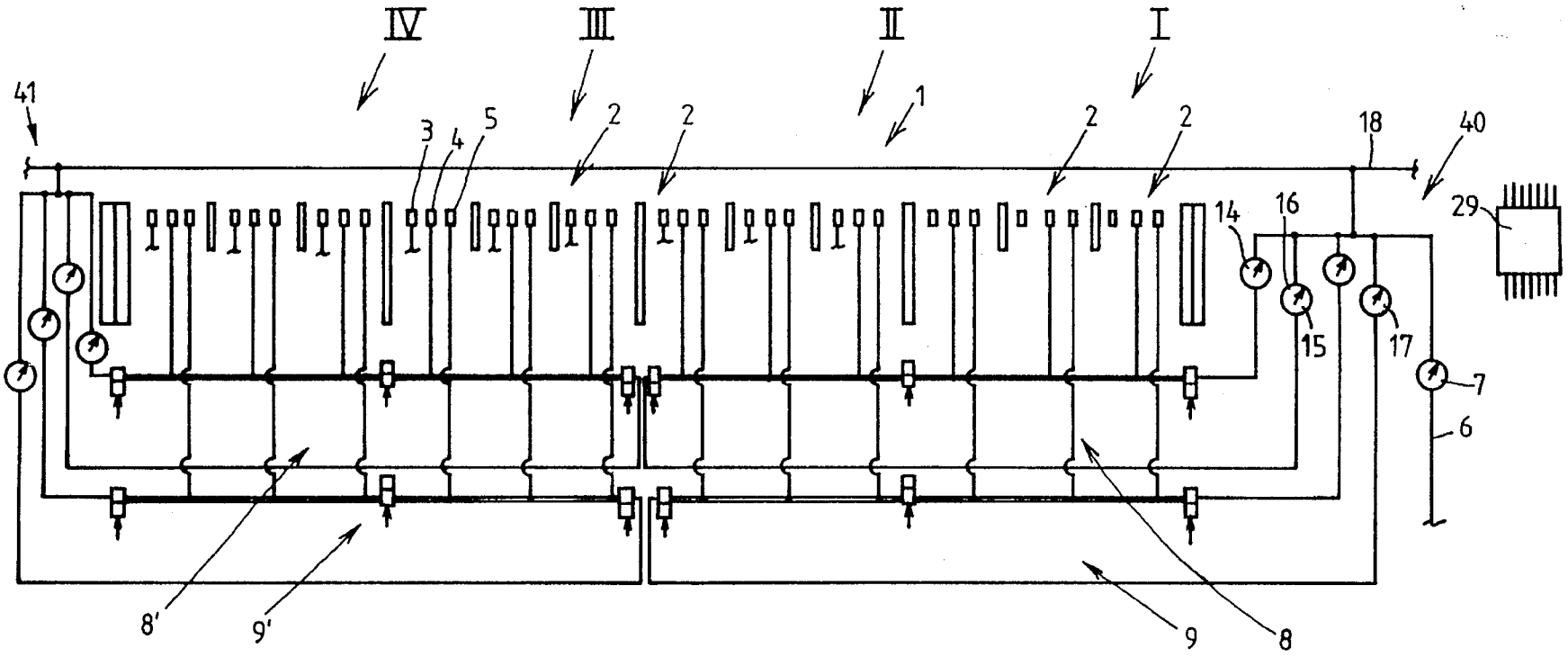
FIG. 5 is a further schematic diagram depicting a fifth embodiment of the present invention.
Figure 6:
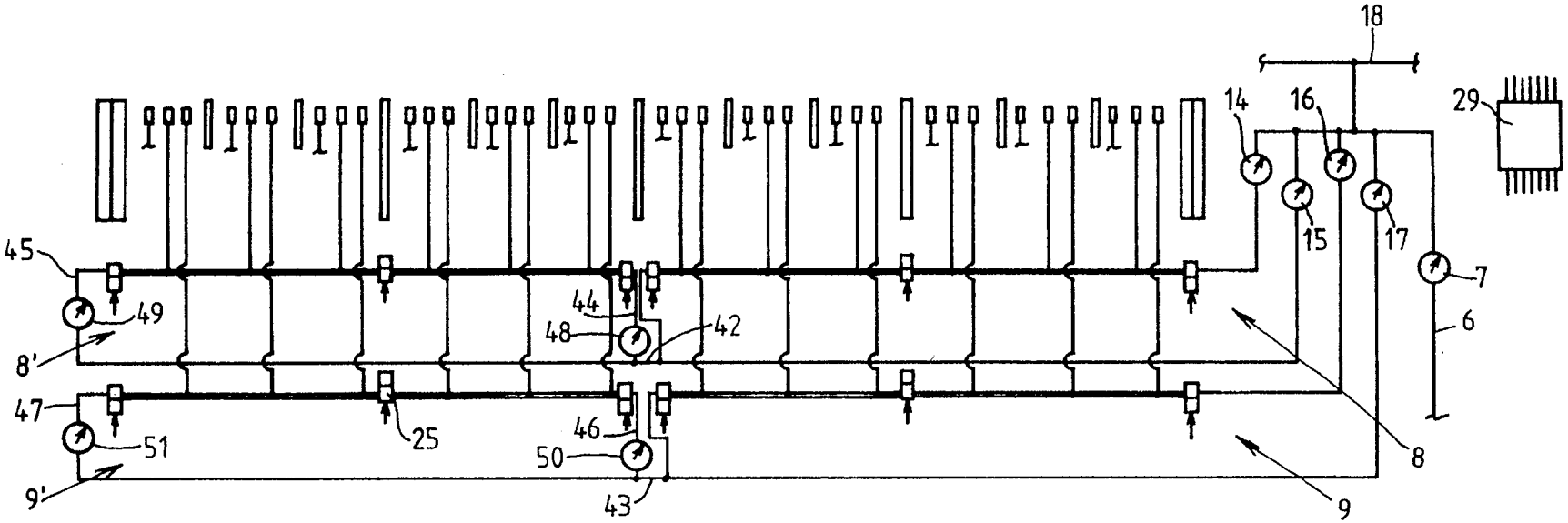
FIG. 6 is a further schematic diagram depicting a sixth embodiment of the present invention.

The exemplary embodiments of FIGS. 5 and 6 show a bobbin winding machine whose compressed air distribution network is embodied such that four different types of yarn can optionally be processed simultaneously.

The embodiment of FIG. 5 is in principle a doubling of the apparatus disclosed in FIG. 1. Energy supply units 40 and 41 are disposed at each opposite end of the bobbin winding machine 1 and, in the manner disclosed in FIG. 1, each has a number of pressure controllers which communicate with respective compressed air lines 8, 9 and 8', 9'. The design of the compressed air lines 8, 9 and 8', 9', respectively, are essentially identical to one another and equivalent to the design of the compressed air lines described in the exemplary embodiment of FIG. 1.

The embodiment shown in FIG. 6 has two pair of compressed air lines 8, 8' and 9, 9', respectively, the lines of each pair being connected in series with one another. In particular, each compressed air line 8', 9' is coupled to its associated compressed air line 8, 9 via a respective connecting line 42, 43, the connecting line 42 in turn branching into connecting lines 44,45 and the connecting line 43 similarly branching into connecting lines 46,47. Pressure controllers 48, 49 and 50, 51, respectively, are also incorporated into the connecting lines 44, 45 and 46, 47, respectively. In such an arrangement, however, care must be taken that the pressure level present in the compressed air lines 8' and 9' always be maintained below the pressure level of the preceding compressed air lines 8 and 9, respectively.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A textile winding machine for producing cross-wound bobbins comprising a plurality of winding stations each having a plurality of pneumatically actuable operating components operable at different working pressures, and a compressed air distribution network comprising compressed air lines extending along the textile machine each carrying pressurized air at a respective defined working pressure and branch lines associated with each winding station for connecting the operating components thereof to the compressed air lines, wherein the network comprises at least two compressed air supply locations to each compressed air line, a pressure controller associated with each supply location, and a plurality of valve elements at selected locations in each compressed air line between the supply locations for dividing the compressed air line into segments defined by the valve elements, the valve elements being selectively actuable for controlling communication of each segment with one compressed air supply location and the pressure controller associated therewith, whereby compressed air may be supplied to the segments at different pressure levels from one another according to the pressure controllers.

2. The textile winding machine of claim 1, wherein the compressed air supply locations are disposed at the ends of the respective compressed air lines.

3. The textile winding machine of claim 1, and further comprising a control device for actuating the valve elements.

4. The textile winding machine of claim 1, wherein the winding stations of the machine are grouped into sections each comprising a sub-plurality of winding stations and the valve elements are each disposed at boundary regions between the machine sections to correspond each segment with a respective machine section.

5. The textile winding machine of claim 1, wherein the valve elements are disposed between each succeeding winding station.

6. The textile winding machine of claim 1, wherein the pressure level of the compressed air within the respective segments of the compressed air lines is selectively adjustable individually via the pressure controllers.

7. The textile winding machine of claim 1, wherein at least one of the compressed air lines is equipped with a third pressure controller and a third compressed air supply location for selectively establishing three different pressure levels in the at least one compressed air line thereby for operating the machine to produce three different batches of yarn.

8. The textile winding machine of claim 1, wherein at least one of the compressed air lines is equipped with third and fourth pressure controllers.

9. A textile winding machine for producing cross-wound bobbins comprising a plurality of winding stations each having a pneumatically actuable operating component, and a compressed air distribution network comprising a compressed air line extending along the textile machine carrying pressurized air at a respective defined working pressure and branch lines associated with each winding station for connecting the operating components thereof to the compressed air line, wherein the network comprises at least two compressed air supply locations to the compressed air line, a pressure controller associated with each supply location, and at least one valve element at a selected location in the compressed air line between the supply locations for dividing the compressed air line into segments defined by the valve element, the valve element being selectively actuable for controlling communication of each segment with one compressed air supply location and the pressure controller associated therewith, whereby compressed air may be supplied to the segments at different pressure levels from one another according to the pressure controllers.

* * * * *